US007911429B2

(12) United States Patent
Park et al.

(10) Patent No.: US 7,911,429 B2
(45) **Date of Patent: *Mar. 22, 2011**

(54) PROGRAMMABLE LIQUID CRYSTAL DISPLAY DEVICE FOR CONTROLLING VIEWING ANGLE AND DRIVING METHOD THEREOF

(75) Inventors: Joon Kyu Park, Gyeonggi-do (KR); Hyun Suk Jin, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 863 days.

This patent is subject to a terminal disclaimer.

(21) Appl. No.: 11/812,909

(22) Filed: Jun. 22, 2007

(65) Prior Publication Data

US 2008/0158264 A1 Jul. 3, 2008

(30) Foreign Application Priority Data

Dec. 29, 2006 (KR) ..... 10-2006-0137375

(51) Int. Cl.
*G09G 3/36* (2006.01)

(52) U.S. Cl. ..... 345/88; 345/690

(58) Field of Classification Search ..... 345/88, 345/204, 690, 87

See application file for complete search history.

(56) References Cited

U.S. PATENT DOCUMENTS

| | | | | |
|---|---|---|---|---|
| 7,675,598 | B2 * | 3/2010 | Hong | 349/141 |
| 7,728,941 | B2 * | 6/2010 | Jin et al. | 349/141 |
| 2007/0040780 | A1 * | 2/2007 | Gass et al. | 345/87 |
| 2007/0152932 | A1 * | 7/2007 | Chung et al. | 345/88 |
| 2008/0001874 | A1 * | 1/2008 | Seo et al. | 345/87 |

* cited by examiner

*Primary Examiner* — Regina Liang
*Assistant Examiner* — Tom V Sheng
(74) *Attorney, Agent, or Firm* — Morgan, Lewis & Bockius LLP

(57) ABSTRACT

A liquid crystal display device includes a liquid crystal panel having a plurality of color subpixels and a plurality of interference subpixels, an input unit for inputting color subpixel data to be applied to the color subpixels, a programmable interference data generating unit for storing viewing mode data to be applied to the interference subpixels, the viewing mode data including interference subpixel data and offset subpixel data, the programmable interference data generating unit selectively outputting one of the stored interference subpixel data and offset subpixel data, and a panel driving unit for driving the color subpixels and the interference subpixels in response to the color subpixel data and selected one of the interference subpixel data and the offset subpixel data.

18 Claims, 6 Drawing Sheets

PROGRAMMABLE LIQUID CRYSTAL DISPLAY DEVICE FOR CONTROLLING VIEWING ANGLE AND DRIVING METHOD THEREOF

This application claims the benefit of the Korean Patent Application No. 10-2006-137375 filed on Dec. 29, 2006, which is hereby incorporated by reference.

BACKGROUND OF THE INVENTION

1. Field of the Invention

The present invention relates to a liquid crystal display (LCD) device, and more particularly, to an LCD device and a driving method thereof for controlling an angle at which an image is viewed.

2. Discussion of the Related Art

In general, an LCD device controls light transmitted through liquid crystals in accordance with video data to display an image corresponding to the video data. The LCD device makes possible a large sized screen beyond a limit, a slim profile, and lightweight. Accordingly, the LCD device is commonly used as a display device for computers and television receivers as a substitute for cathode ray tube (CRT) display devices.

Recently, users of portable devices such as portable phones, personal digital assistants (PDAs), and portable computers have a desire to prevent the data being displayed on the portable device from being viewed by other people. Therefore, it is desirable for LCD display devices in portable devices to include a narrow viewing angle mode as well as a normal viewing angle mode so that privacy and security can be achieved.

To achieve viewing angle control, a liquid crystal panel with viewing angle control mode includes a separate interference subpixel added to a color pixel. An example of a liquid crystal panel with viewing angle control mode includes a double structure liquid crystal panel. As shown in FIG. 1, a double structure liquid crystal panel includes a normal panel 10 in which color pixels are formed, and an interference panel 12 located on the normal panel 10. The interference panel 12 includes interference subpixels. The normal panel 10 is used for displaying an image while the interference panel 12 blocks light propagating in a lateral direction of the normal panel 10. In other words, the double structure liquid crystal panel switches between viewing angle modes of an image by blocking light propagating in a lateral direction of the normal panel 10 using the interference panel 12.

An LCD device with the double structure liquid crystal panel controls a viewing angle by selectively driving the interference panel 12 to select between a wide viewing angle mode and a narrow viewing angle mode. In other words, the LCD device turns on or off the interference panel 12 depending on the desired viewing angle mode. However, because external light needs to pass through the double liquid crystal layer in the above-described double structure liquid crystal panel, brightness of an image is significantly decreased. Additionally, the double structure liquid crystal panel has increased thickness and weight.

An alternative viewing angle control mode liquid crystal panel includes a region division-type liquid crystal panel in which color pixels and interference subpixels are arranged on the same plane. Color pixels on the region division-type liquid crystal panel include red, green, and blue subpixels as well as interference subpixels. Since the interference subpixels and the color subpixels are arranged on the same plane, the region division-type liquid crystal panel does not increase the thickness and weight of the panel. Also, since the region division-type liquid crystal panel controls the viewing angle using only one liquid crystal layer, the amount of light, brightness, and color purity are not diminished.

An LCD device including a viewing angle control mode liquid crystal panel selectively drives interference subpixels on the viewing angle control mode liquid crystal panel to display an image at a normal viewing angle and at a narrow viewing angle. In other words, only the color subpixels are driven when the LCD device displays an image at a normal viewing angle. On the other hand, the color subpixels and the interference subpixels are driven when the LCD device displays an image at a narrow viewing angle. A related art LCD device that controls the viewing angle using interference subpixels increases the brightness using interference subpixels according to a predetermined pattern during a narrow viewing angle mode by driving interference subpixels and color subpixels simultaneously.

In the related art LCD device that controls the viewing angle using interference subpixels, the increased brightness of interference subpixels according to the predetermined pattern effectively prevents viewing of images with outlines having a large degree of brightness change, such as a text including letters, from a lateral side. However, it is difficult to block an image with a small degree of brightness change, such as a picture, from being viewed from the lateral side. In addition, since the pattern is fixed, text images with small outline changes may be viewed, though dimly, from the lateral side. Accordingly, maintaining confidentiality and security of displays regardless of the kind of an image have been difficult in the related art LCD device with viewing angle controls.

SUMMARY OF THE INVENTION

Accordingly, the present invention is directed to a liquid crystal display device with a viewing angle control mode that substantially obviates one or more problems due to limitations and disadvantages of the related art, and a driving method thereof.

An object of the present invention is to provide a liquid crystal display device and a driving method thereof for controlling a viewing angle of the liquid crystal display device to control confidentiality and security of a display regardless of the kind of an image.

Another object of the present invention is to provide a liquid crystal display device and a driving method thereof for controlling a viewing angle to control levels of confidentiality and security of the display.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal panel having a plurality of color subpixels and a plurality of interference subpixels, an input unit for inputting color subpixel data to be applied to the color subpixels, a programmable interference data generating unit for storing viewing mode data to be applied to the interference subpixels, the viewing mode data including interference subpixel data and offset subpixel data, the programmable interference data generating unit selectively outputting one of the stored interference subpixel data and offset subpixel data, and a panel driving unit for driving the color subpixels and the interference subpixels in response to the color subpixel data and selected one of the interference subpixel data and the offset subpixel data.

In another aspect, a method for driving a liquid crystal display device to control a viewing angle, the method includes the steps of storing interference subpixel data to be used for interference subpixels on a liquid crystal panel in a memory, inputting color subpixel data to be used for color subpixels on the liquid crystal panel, selecting between the interference subpixel data stored in the memory and offset subpixel data, and driving the color subpixels and the interference subpixels in response to the color subpixel data and the selected one of the interference subpixel data and the offset subpixel data.

In yet another aspect, a liquid crystal display device includes a liquid crystal panel including a plurality of color subpixels and at least one interference subpixel, a programmable interference data generating unit to generate viewing mode data to be applied to the interference subpixel, the viewing mode data being selected to switch between a narrow viewing angle mode and a wide viewing angle mode, a video data combining unit to combine color data to be applied to the color subpixels with the viewing mode data, and a panel driving unit to apply the color data and the viewing mode data to corresponding color subpixels and the interference subpixel.

The programmable interference data generating unit for a liquid crystal display device with a plurality of color subpixels and at least one interference subpixel includes a first storage unit to store interference subpixel data to be applied to the interference subpixel, a second storage unit to store offset subpixel data to be applied to the interference subpixel, and a selector to select between the interference subpixel data and the offset subpixel data, wherein the interference subpixel data is selected for a narrow viewing angle mode and the offset subpixel data is selected for a wide viewing angle mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
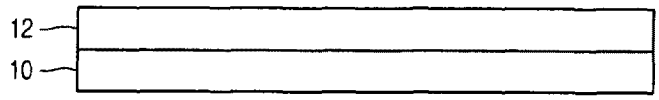
Fig. 1 (Related Art)
FIG. 1 is a schematic cross-sectional view illustrating a liquid crystal panel TO control a viewing angle according to a related art.
Figure 2:
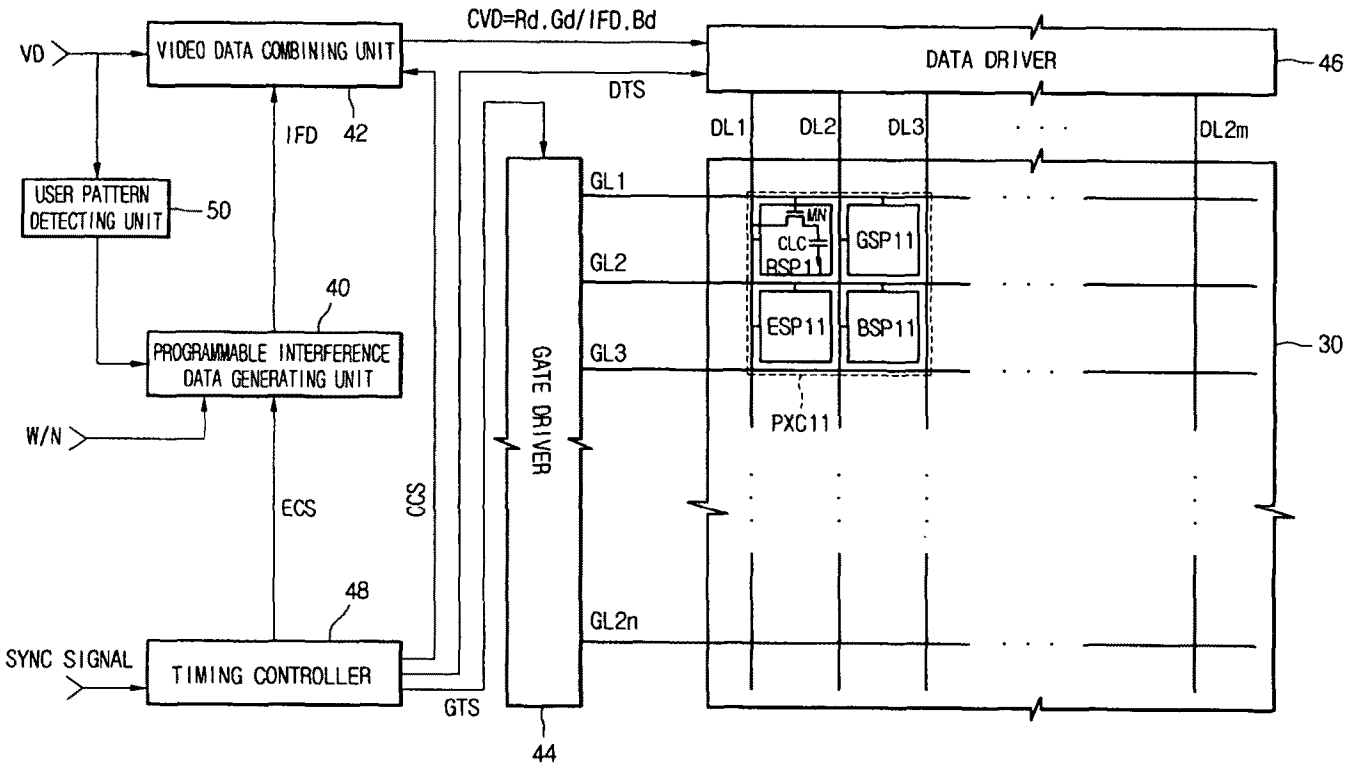
FIG. 2 is a schematic block diagram illustrating a programmable liquid crystal display device TO control a viewing angle according to an exemplary embodiment of the present invention.

FIG. 2 is a schematic block diagram illustrating a programmable liquid crystal display device in accordance with an exemplary embodiment of the present invention to control a viewing angle of the liquid crystal display device.

The programmable liquid crystal display device of FIG. 2 includes a programmable interference data generating unit 40 for generating interference subpixel data to be supplied to interference subpixels $ESP_{11}$ to $ESP_{mn}$ on a liquid crystal panel 30 and a video data combining unit 42 for adding interference data IFD from the programmable interference data generating unit 40 to video data VD received from an external video source.

The liquid crystal panel 30 includes red subpixels $RSP_{11}$-$RSP_{mn}$, green subpixels $GSP_{11}$-$GSP_{mn}$, blue subpixels $BSP_{11}$-$BSP_{mn}$, and interference subpixels $ESP_{11}$-$ESP_{mn}$ formed in regions defined by a plurality of data lines $DL_1$-$DL_{2m}$ arranged in a horizontal direction and a plurality of gate lines $GL_1$-$GL_{2n}$ arranged in a vertical direction. Each of the subpixels $RSP_{11}$-$RSP_{mn}$, $GSP_{11}$-$GSP_{mn}$, $BSP_{11}$-$BSP_{mn}$, and $ESP_{11}$-$ESP_{mn}$ includes a liquid crystal cell CLC connected to a common electrode Vcom and a thin film transistor (TFT) MN to selectively apply a subpixel drive signal to the liquid crystal cell CLC from the data line DL in response to a scan signal on the gate line GL. Red subpixels $RSP_{11}$-$RSP_{mn}$ are connected to odd-numbered gate lines (e.g., $GL_1$, $GL_3$, $GL_5 \ldots GL_{2n-1}$) and odd-numbered data lines (e.g., $DL_1$, $DL_3$, $DL_5 \ldots DL_{2m-1}$). Green subpixels $GSP_{11}$-$GSP_{mn}$ are connected to odd-numbered gate lines (e.g., $GL_1$, $GL_3$, $GL_5 \ldots GL_{2n-1}$) and even-numbered data lines (e.g., $DL_2$, $DL_4$, $DL_6 \ldots DL_{2m}$). Blue subpixels $BSP_{11}$-$BSP_{mn}$ are connected to even-numbered gate lines (e.g., $GL_2$, $GL_4$, $GL_6 \ldots GL_{2n}$) and even-numbered data lines (e.g., $DL_2$, $DL_4$, $DL_6 \ldots DL_{2n}$). Interference subpixels $ESP_{11}$-$ESP_{mn}$ are connected to even-numbered gate lines (e.g., $GL_2$, $GL_4$, $GL_6 \ldots GL_{2n}$) and odd-numbered data lines (e.g., $DL_1$, $DL_3$, $DL_5 \ldots DL_{2m-1}$).

Each of the interference subpixels $ESP_{11}$-$ESP_{mn}$ form one group together with each red, green, and blue subpixels $RSP_{11}$-$RSP_{mn}$, $GSP_{11}$-$GSP_{mn}$, and $BSP_{11}$-$BSP_{mn}$ adjacent in an upper direction and a right direction to constitute color pixels $PXC_{11}$-$PXC_{mn}$ to control a viewing angle. Accordingly, a first color pixel $PXC_{11}$ on a first line includes red and green subpixels $RSP_{11}$ and $GSP_{11}$ connected to a first gate line $GL_1$ in common and connected to a first data line $DL_1$ and a second data line $DL_2$, respectively. Interference and blue subpixels $ESP_{11}$ and $BSP_{11}$ are connected to a second gate line $GL_2$ in common and connected to a first data line $DL_1$ and a second data line $DL_2$, respectively. In this manner, the last color pixel $PXC_{mn}$ on the last line includes red and green subpixels $RSP_{mn}$ and $GSP_{mn}$ connected to a (2n−1)th gate line $GL_{2n-1}$ in common and red and green subpixels $RSP_{mn}$ and $GSP_{mn}$ connected to a (2m−1)th data line $DL_{2m-1}$ and a (2m)th data line $DL_{2m}$, respectively. Interference and blue subpixels $ESP_{mn}$ and $BSP_{mn}$ are connected to a (2n)th gate line $GL_{2n}$ in common and interference and blue subpixels $ESP_{mn}$ and $BSP_{mn}$ connected to a (2m−1)th data line $DL_{2m-1}$ and a (2m)th data line $DL_{2m}$, respectively.

Figure 3A:
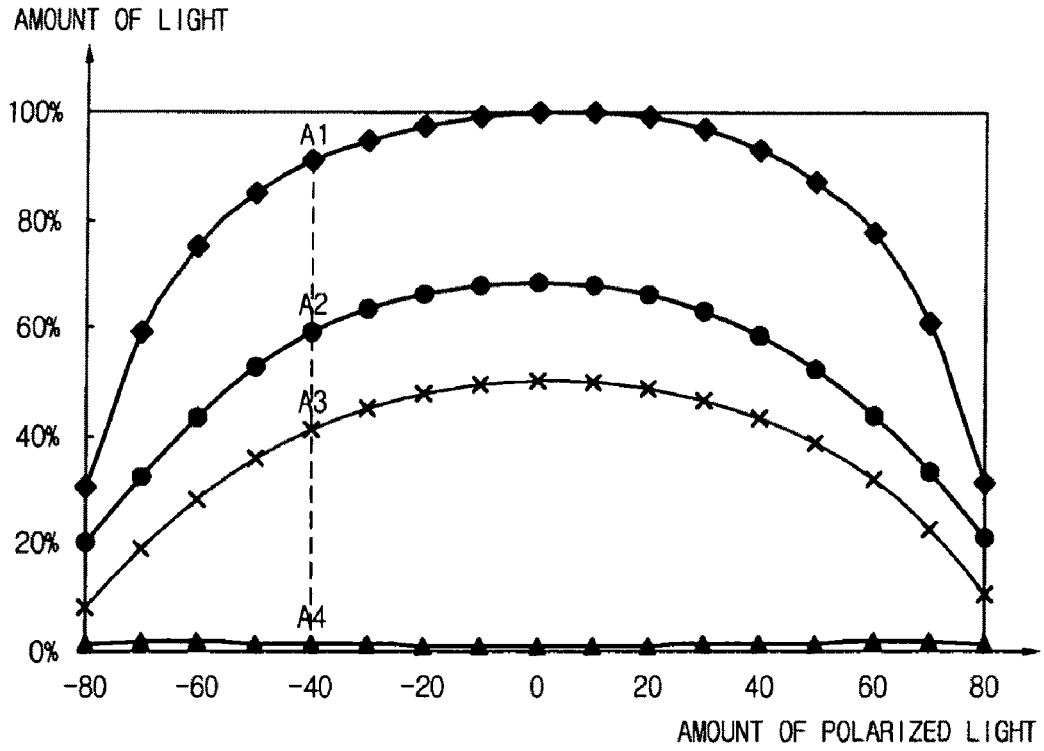
FIGS. 3A to 3C are views explaining a polarization characteristic of an liquid crystal panel according to an exemplary embodiment of the present invention.
Figure 3B:
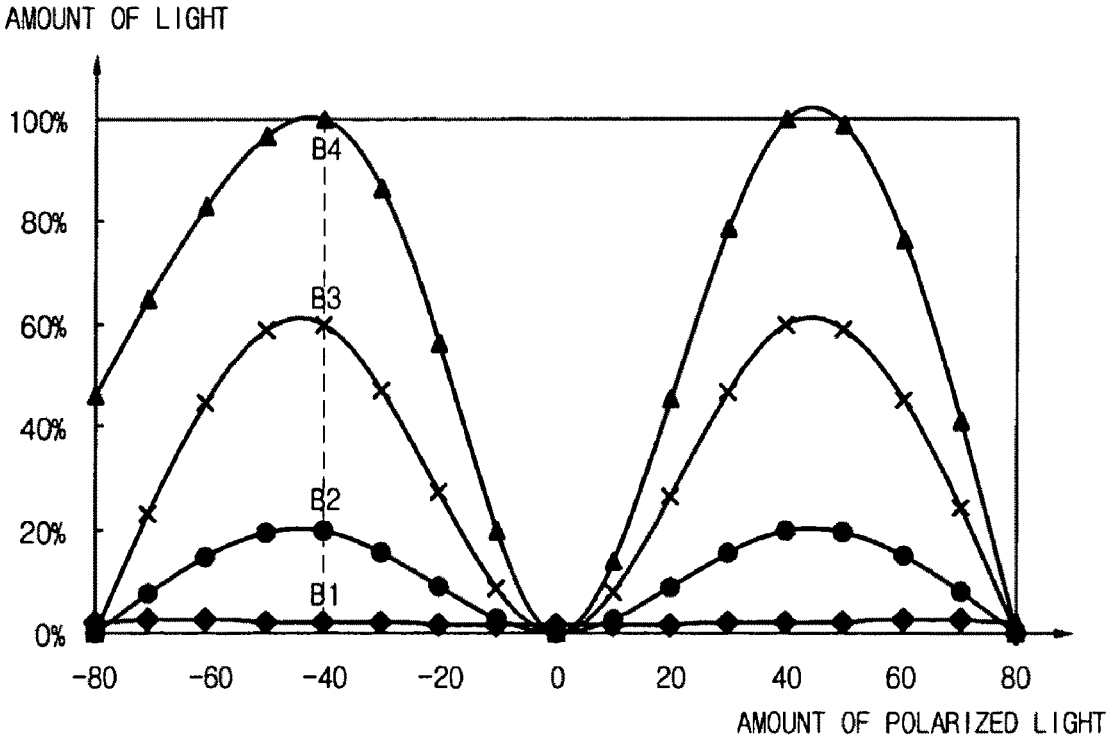

As shown in FIG. 3A, the color subpixels (RSP, GSP, BSP) are driven by a horizontal electric field to polarize transmitted light so that an amount of light decreases as a viewing angle increases from the front of the liquid crystal panel 30 to the side in a lateral direction. Accordingly, an image displayed on the liquid crystal panel 30 can be viewed from a lateral side that is at a wide angle with respect to the front of the liquid crystal panel 30. In other words, the liquid crystal panel 30 is operating at a wide viewing angle mode. On the other hand, as shown in FIG. 3B, the interference subpixel ESP is driven using a vertical electric field to polarize the light so that an amount of light perceived at about 40° from either side of the front of the liquid crystal panel 30 is maximized.

Figure 3C:
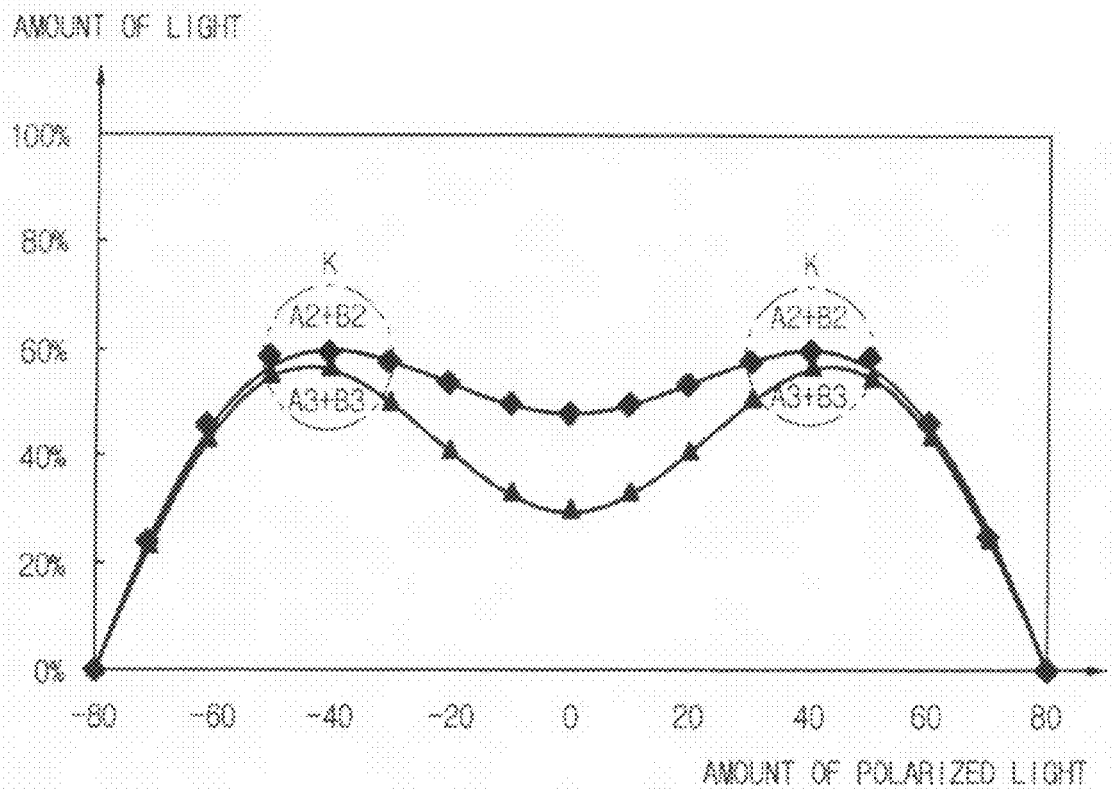

As shown in FIG. 3C, light propagating in the side directions due to the interference subpixels ESP merges with light propagating in both side directions from the color subpixels RSP, GSP, and BSP to have a polarization strength characteristic that maximizes an amount of light propagating to a lateral direction at about 40° from the front of the liquid crystal panel 30 and decreases an amount of light at the front of the liquid crystal panel 30. Therefore, the amount of light polarized on both sides at about 40° from the front of the liquid crystal panel 30 due to the interference subpixels ESP is added to the amount of light from the color subpixels RSP, GSP, and BSP. As a result, an image on the liquid crystal panel 30 viewed at an angle of about 40° from both sides of the liquid crystal panel 30 appears different than the original image data.

As shown in FIG. 2, the programmable interference data generating unit 40 supplies interference data IFD to a video data combining unit 42 in response to a wide/narrow (W/N) mode control signal from an external video source (e.g., a graphic card of a computer). The interference data IFD is used to switch a viewing angle of the liquid crystal panel 30 between a wide and narrow viewing angle. The interference data IFD includes interference subpixel data ($E_d$) of an image having an interference pattern. The interference subpixel data ($E_d$) allows interference light to be added to both side directions from the front of the liquid crystal panel 30 when the W/N mode control signal has a predetermined logic (e.g., a high or low logic) indicating a narrow viewing angle mode.

An interference pattern includes a fixed interference pattern and an erasable interference pattern set in advance by a manufacturer. The fixed interference pattern includes logo or letters of a predetermined company, for example, and is stored in memory so that it cannot be deleted. Alternatively, the erasable interference pattern may be updated at any time by the user. To update the erasable interference pattern, the programmable interference data generating unit 40 is connected to an external video source (e.g., a graphic module of a computer system) via a user pattern detecting unit 50. The programmable interference data generating unit 40 inputs a user interference pattern (i.e., an interference pattern loaded by the user) from the user pattern detecting unit 50 to update an existing erasable interference pattern. The user pattern detecting unit 50 detects a user interference pattern contained (or transmitted) during a vertical blanking interval of a vertical synchronization signal of data streams from the external video source. The user pattern detecting unit 50 then supplies the detected user interference pattern to the programmable interference data generating unit 40. In the case where the W/N mode control signal has an initialization logic designating a wide viewing angle mode, the interference data IFD includes offset subpixel data ($E_{off}$) having an offset value that prevents interference light from propagating to both side directions from the front side of the liquid crystal panel 30.

The video data combining unit 42 receives video data VD including color subpixel data of red, green, and blue subpixels (RSP, GSP, BSP) from the external video source (not shown). The video combining unit 42 adds interference data IFD from the programmable interference data generating unit 40 to the video data VD. Also, the video data combining unit 42 rearranges color subpixel data and interference subpixel data ($E_d$) (or offset subpixel data $E_{off}$) so that these data coincide with an arrangement state of the subpixels on the liquid crystal panel 30 to generate combined video data CVD. The combined video data CVD prepared by the video data combining unit 42 includes a subpixel data stream where red and green subpixel data ($R_d$ and $G_d$) are alternated when red and green subpixels (RSP and GSP) connected to odd-numbered gate lines $GL_1$-$GL_{2n-1}$ of the liquid crystal panel 30 are scanned. The combined video data CVD also includes a subpixel data stream where interference (or offset) and blue subpixel data $E_d$ (or $E_{off}$) and $B_d$ are alternated when interference and blue subpixels ESP and BSP connected to even-numbered gate lines $GL_2$-$GL_{2n}$ of the liquid crystal panel 30 are scanned.

The programmable LCD device further includes a gate driver 44 for sequentially driving gate lines $GL_1$-$GL_{2n}$ on the liquid crystal panel 30, a data driver 46 for driving data lines $DL_1$-$DL_{2m}$ on the liquid crystal panel 46, and a timing controller 48 for controlling operation timings of the data and gate drivers 44 and 46. The gate driver 44 generates 2n scan signals sequentially enabling the gate lines $GL_1$-$GL_{2n}$ in response to gate timing signals GTS from the timing controller 48. The gate lines $GL_1$-$GL_{2n}$ on the liquid crystal panel 30 are enabled sequentially and exclusively by a period corresponding to half of the period of a horizontal synchronization signal by the 2n scan signals.

The data driver 46 supplies subpixel drive signals to 2m data lines $DL_1$-$DL_{2m}$ whenever one of the gate lines $GL_1$-$GL_{2n}$ is enabled in response to data timing signals DTS from the timing controller 48. For this purpose, the data driver 46 receives combined video data CVD transmitted in series from the video data combining unit 42. When columns of red and green subpixels (RSP and GSP) connected to one of odd-numbered gate lines $GL_1$-$GL_{2n-1}$ are scanned, the data driver 46 inputs a subpixel data stream where red and green subpixel data ($R_d$ and $G_d$) are alternated to allow red subpixel drive signals to be supplied to odd-numbered data lines $DL_1$-$DL_{2m-1}$, respectively, and to allow green subpixel drive signals to be supplied to even-numbered data lines $DL_2$-$DL_{2m}$, respectively. On the other hand, when columns of interference and blue subpixels (ESP and BSP) connected to one of even-numbered gate lines $GL_2$-$GL_{2n}$ are scanned, the data driver 46 inputs a subpixel data stream where interference (or offset) and blue subpixel data $E_d$ (or $E_{off}$) and $B_d$ are alternated to allow interference subpixel drive signals to be supplied to odd-numbered data lines $DL_1$-$DL_{2m-1}$, respectively, and to allow blue subpixel drive signals to be supplied to even-numbered data lines $DL_2$-$DL_{2m}$, respectively.

Figure 4A:
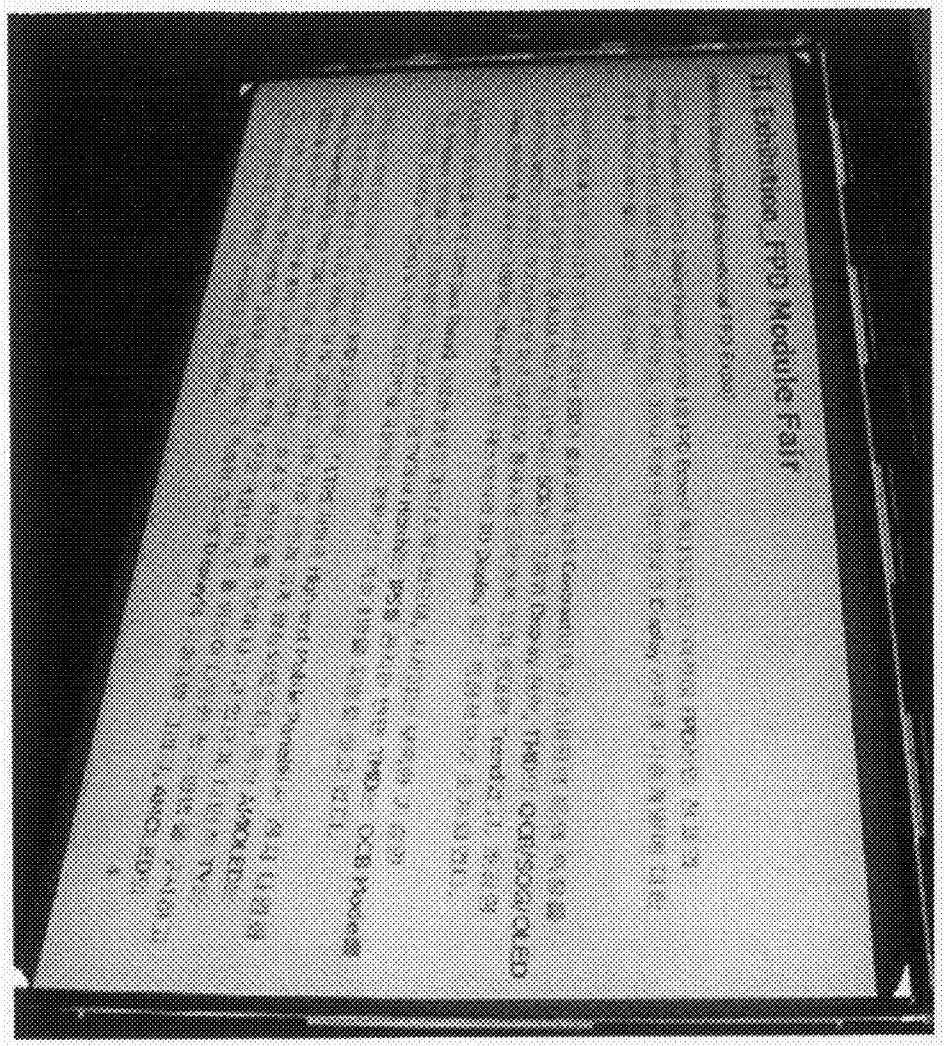
FIGS. 4A and 4B are lateral side views illustrating an image state on a liquid crystal panel of the liquid crystal display device of FIG. 2 according to a wide viewing angle mode and a narrow viewing angle mode, respectively.
Figure 4B:
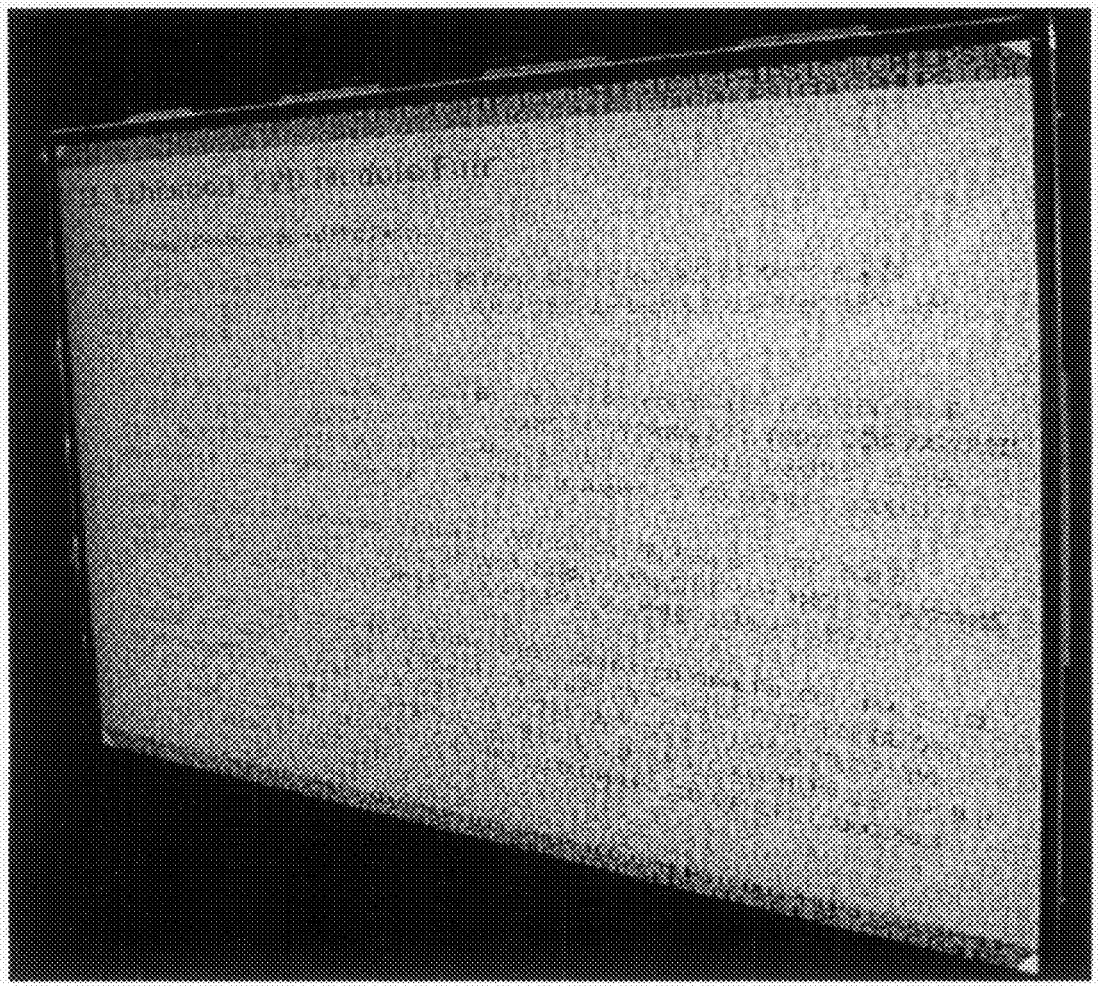

When the W/N mode control signal generates a predetermined logic for a narrow viewing angle, an interference subpixel drive signal has a voltage allowing an interference subpixel ESP to transmit interference light to both side directions from the front side of the liquid crystal panel 30. An amount of light transmitted to both side directions by the interference subpixel ESP is controlled by a voltage level of the interference subpixel drive signal. The amount of light transmitted to both side directions due to the interference subpixels (ESP) is added to the amount of light transmitted to both side directions by the color subpixels (RSP, GSP, BSP), so that a brightness interference component at the side directions is perceived. Accordingly, as shown in FIG. 4B, an image that cannot be recognized from the side direction is displayed on the liquid crystal panel 30. Also, the interference subpixel drive signals have different voltage levels for each of the interference subpixels $ESP_{11}$-$ESP_{mn}$ corresponding to interference patterns, so that a difference in an amount of brightness interference is generated between color pixels PXC. Accordingly, an image displayed on the liquid crystal panel 30 cannot be recognized from the side directions. Consequently, confidentiality and security of the display are maintained during a narrow viewing angle mode.

Moreover, the degree of recognition of an image from the side directions can be controlled depending on the density of letters and characters contained in the erasable interference pattern. For this purpose, a user loads an interference pattern containing letters and characters of an appropriate density depending on the desired degree of security and confidentiality to the programmable interference data generating unit 40. Therefore, the programmable LCD device that controls the viewing angle according to the present invention not only enhances maintaining confidentiality and security of the display but also controls the degree of confidentiality and security.

When the W/N mode control signal has an initialization logic indicating a wide viewing angle, the interference subpixel ESP responds to an offset pixel drive signal having an offset voltage that prevents interference light from being transmitted to the side directions as well as to the front side of the liquid crystal panel 30. An amount of light passing through the interference subpixels ESP disappear due to the offset subpixel drive signal so that only red, green, and blue subpixels (RSP, GSP, BSP) allow light to pass through the entirety of the liquid crystal panel 30. Accordingly, as shown in FIG. 4A, an image displayed on the liquid crystal panel 30 can be viewed from the side directions as well as the front side.

The timing controller 48 receives synchronization signals SYNC (i.e., horizontal and vertical synchronization signals and a data clock) from an external video source. The timing controller 48 generates gate timing signals GTS to be supplied to the gate driver 44 and data timing signals DTS to be supplied to the data driver 46 using the synchronization signals SYNC. Also, the timing controller 48 generates interference control signals ECS required for a data generating operation and an erasable interference pattern updating operation of the programmable interference data generating unit 40, and combining control signals CCS required for data combining operation of the video data combining unit 42.

Figure 5:
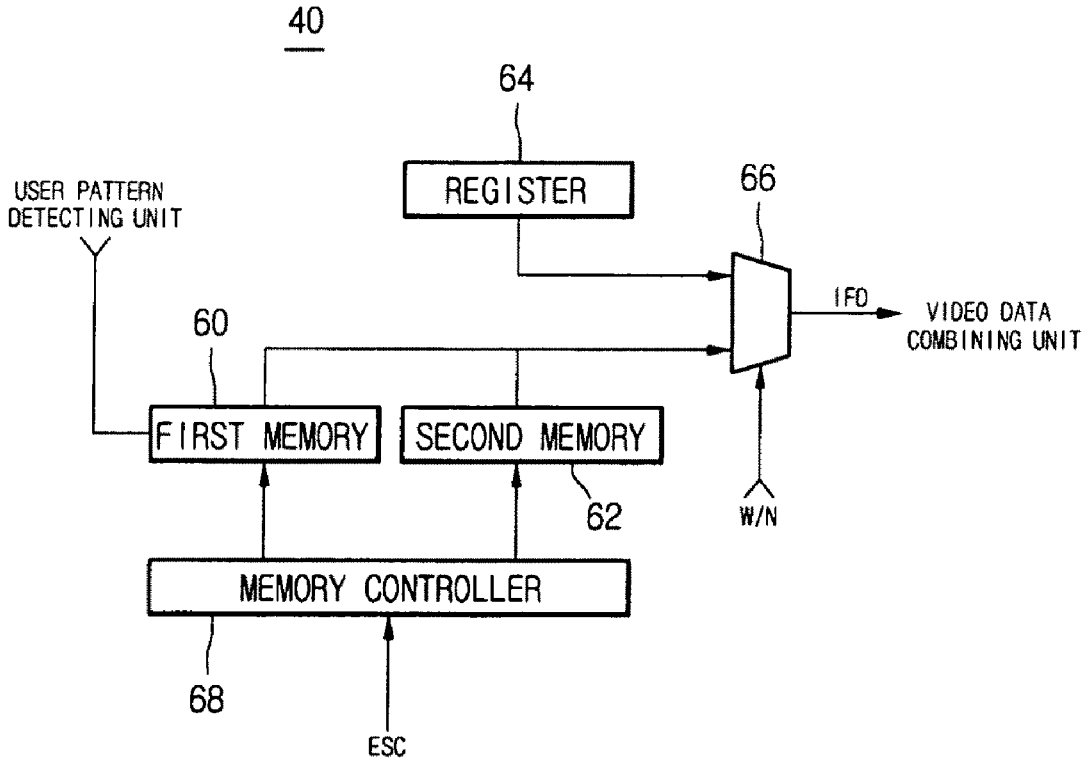
FIG. 5 is a block diagram of an exemplary embodiment of a programmable interference data generating unit of FIG. 2.

FIG. 5 is a detailed block diagram of an exemplary embodiment of the programmable interference data generating unit of FIG. 2. As shown in FIG. 5, the programmable interference data generating unit 40 includes a first memory 60 and a second memory 62 in which interference patterns are stored, respectively, and a register 64 in which offset subpixel data is stored. The register 64 may be replaced by a plurality of switches, for example, that can generate offset subpixel data $E_{off}$.

The interference pattern stored in the first memory 60 may be updated with a new user pattern from the user pattern detecting unit 50 of FIG. 2. In other words, the first memory 60 updates the already existing interference pattern into a new user pattern whenever a new user pattern is input from the user pattern detecting unit 50. Confidentiality and security of data displayed on the liquid crystal panel 30 can be enhanced or alleviated by an updating operation of the first memory 60. Therefore, a degree of recognition of an image from the side directions may be controlled. The first memory 60 may be a non-volatile memory (e.g., static random access memory (SRAM) or electrically erasable programmable random access memory (EEPROM)) which maintains a stored erasable interference pattern even when power is not supplied. The first memory 60 can have the same storage capacity corresponding to or smaller than the number of interference subpixels on the liquid crystal panel 30. This is because the first memory 60 can generate interference subpixel data corresponding to the number of the interference subpixels on the liquid panel 30 using a repeated reading operation of the first memory 60 even when the storage capacity of the first memory is smaller than the number of the interference subpixels on the liquid crystal panel 30.

The fixed interference pattern stored in the second memory 62 is a pattern programmed by a manufacturer, for example, and is not erasable, so that an interference pattern to be used for performing a viewing angle control is available even when the interference pattern is not stored in the first memory 60. Reading operations of the first and second memories 60 and 62 are selectively performed under control of a memory controller 68. The memory controller 68 controls a reading operation of the second memory 62 to be performed when there is no interference pattern stored in the first memory 60. The memory controller 68 controls a selective reading operation of the first and second memories 60 and 62, and an interference pattern updating operation of the first memory 60 in response to an interference control signal ESC from the timing controller 48 of FIG. 2.

A selector 66 transmits either an offset subpixel data ($E_{off}$) from the register 64 or an interference subpixel data ($E_d$) from one of the first and second memories 60 and 62 as interference data IFD to the video data combining unit 42 of FIG. 2 in response to a logic value of the W/N mode control signal. When the W/N mode control signal has a predetermined logic (i.e., a high or low logic) indicating a narrow viewing angle mode, the selector 66 allows interference subpixel data ($E_d$) from one of the first and second memories 60 and 62 to be supplied as interference data IFD to the video data combining unit 42 of FIG. 2. On the other hand, if the W/N mode control signal has an initialization logic (i.e., a high or low logic) designating a wide viewing angle mode, the selector 66 allows offset subpixel data ($E_{off}$) from the register 64 to be supplied as interference data IFD to the video data combining unit 42 of FIG. 2.

As described above, a programmable LCD device, and a driving method thereof, for controlling a viewing angle according to the present invention includes an interference pattern to be inserted into the displayed image using interference subpixels on a liquid crystal panel. The interference pattern is loaded to a programmable interference data generating unit such that the interference pattern includes letters and characters having density depending on the level of confidentiality and security desired. Therefore, the programmable LCD device and the driving method thereof in accordance with the present invention not only provide confidentiality and security of the displayed image but also allow control of the degree of the confidentiality and security.

It will be apparent to those skilled in the art that various modifications and variations can be made in the programmable LCD device of the present invention and a driving method thereof without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel having a plurality of color subpixels and a plurality of interference subpixels;

an input unit for inputting color subpixel data to be applied to the color subpixels;

a programmable interference data generating unit for storing viewing mode data to be applied to the interference subpixels, the viewing mode data including interference subpixel data and offset subpixel data, the programmable interference data generating unit selectively outputting one of the stored interference subpixel data and offset subpixel data; and a panel driving unit for driving the color subpixels and the interference subpixels in response to the color subpixel data and selected one of the interference subpixel data and the offset subpixel data.

2. The device according to claim 1, further comprising a user pattern detecting unit for detecting the interference subpixel data from the input unit and loading the detected interference subpixel data to the programmable interference data generating unit.

3. The device according to claim 2, wherein the programmable interference data generating unit includes a first memory for storing the interference subpixel data from the user pattern detecting unit;

a register for storing the offset subpixel data; and a selector for selectively supplying one of the interference subpixel data from the first memory and the offset subpixel data from the register to the panel driving unit.

4. The device according to claim 3, wherein the first memory includes a non-volatile memory.

5. The device according to claim 3, wherein the first memory stores a smaller number of interference pixel data than the number of the inference subpixels on the liquid crystal panel.

6. The device according to claim 3, wherein the programmable interference data generating unit further includes a second memory for storing interference subpixel data of a fixed interference pattern.

7. The device according to claim 1, wherein the color subpixels are driven by a horizontal electric field, and the interference subpixels are driven by a vertical electric field.

8. A method for driving a liquid crystal display device to control a viewing angle, the method comprising the steps of:

storing interference subpixel data to be used for interference subpixels on a liquid crystal panel in a memory;

inputting color subpixel data to be used for color subpixels on the liquid crystal panel;

selecting between the interference subpixel data stored in the memory and offset subpixel data; and driving the color subpixels and the interference subpixels in response to the color subpixel data and the selected one of the interference subpixel data and the offset subpixel data.

9. The method according to claim 8, wherein the storing of the interference subpixel data includes the step of searching for the interference subpixel data to be stored in the memory.

10. The method according to claim 9, wherein the searching of the interference subpixel data includes the step of extracting data existing during a blanking period of a vertical synchronization signal.

11. The method according to claim 9, wherein the memory includes a non-volatile memory.

12. The method according to claim 8, wherein the memory stores a smaller number of interference pixel data than the number of the interference subpixels on the liquid crystal panel.

13. The method according to claim 8, wherein the memory further stores a fixed interference pattern, and the selecting between the interference subpixel data and the offset subpixel data comprises the step of selecting between the fixed interference pattern and a programmed interference pattern.

14. The method according to claim 8, wherein the driving of the color subpixels and the interference subpixels includes the steps of:

driving the color subpixels using a horizontal electric field; and driving the interference subpixels using a vertical electric field.

15. A liquid crystal display device, comprising:

a liquid crystal panel including a plurality of color subpixels and at least one interference subpixel;

a programmable interference data generating unit to generate viewing mode data to be applied to the interference subpixel, the viewing mode data being selected to switch between a narrow viewing angle mode and a wide viewing angle mode;

a video data combining unit to combine color data to be applied to the color subpixels with the viewing mode data; and a panel driving unit to apply the color data and the viewing mode data to corresponding color subpixels and the interference subpixel.

16. The device according to claim 15, wherein the programmable interference data generating unit includes:

a first storage unit to store interference subpixel data from the user pattern detecting unit;

a second storage unit to store offset subpixel data; and a selector to select between the interference subpixel data and the offset subpixel data to be supplied as the viewing mode data to the panel driving unit.

17. The device according to claim 16, wherein the first storage unit includes a fixed memory to store fixed interference subpixel data, and a rewritable memory to store user-defined interference subpixel data.

18. The device according to claim 15, further comprising a user pattern detecting unit to detect user-defined interference subpixel data to be stored in the first storage unit of the programmable interference data generating unit.

* * * * *